US010781077B2

(12) United States Patent
Koivisto

(10) Patent No.: US 10,781,077 B2
(45) Date of Patent: Sep. 22, 2020

(54) SOLUTION FOR DISPLACING AN ELEVATOR CAR

(71) Applicant: KONE Corporation, Helsinki (FI)

(72) Inventor: Ari Koivisto, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 261 days.

(21) Appl. No.: 15/819,866

(22) Filed: Nov. 21, 2017

(65) Prior Publication Data

US 2018/0093862 A1 Apr. 5, 2018

Related U.S. Application Data

(63) Continuation of application No. PCT/FI2016/050415, filed on Jun. 10, 2016.

(30) Foreign Application Priority Data

Jun. 17, 2015 (EP) ..... 15172524

(51) Int. Cl.
*B66B 7/02* (2006.01)
*B66B 9/00* (2006.01)
*B66B 7/04* (2006.01)

(52) U.S. Cl.
CPC ..... *B66B 7/021* (2013.01); *B66B 7/046* (2013.01); *B66B 9/003* (2013.01)

(58) Field of Classification Search
CPC ..... B66B 7/021; B66B 9/003
See application file for complete search history.

(56) References Cited

U.S. PATENT DOCUMENTS 4,946,006 A * 8/1990 Kume ..... B66B 9/003 182/141
5,197,570 A 3/1993 Matsui
5,235,144 A * 8/1993 Matsui ..... B66B 9/003 187/250
6,354,404 B1 3/2002 Sansevero et al.
2007/0181374 A1 8/2007 Mueller
(Continued)

FOREIGN PATENT DOCUMENTS

DE 20206290 U1 8/2002
EP 0471464 A2 2/1992
(Continued)

OTHER PUBLICATIONS

International Search Report, issued in PCT/FI2016/050415, PCT/ISA/210, dated Sep. 12, 2016.
(Continued)

*Primary Examiner* — Minh Truong
(74) *Attorney, Agent, or Firm* — Birch, Stewart, Kolasch & Birch, LLP

(57) ABSTRACT

An apparatus for displacing an elevator car from its pathway includes a rotational vehicle configured to rotate around an axis of rotation and at least one guide rail section mounted with the rotational vehicle along, which at least one guide rail section the at least one elevator car is arranged to travel. The at least one guide rail section is mounted substantially parallel to the axis of rotation of the rotational vehicle. The rotational vehicle is configured to rotate 90 degrees. An elevator system is also disclosed.

17 Claims, 4 Drawing Sheets

(56) References Cited

U.S. PATENT DOCUMENTS

| | | | | |
|---|---|---|---|---|
| 2016/0297646 | A1* | 10/2016 | Piech | B66B 11/04 |
| 2019/0077635 | A1* | 3/2019 | King | B66B 9/10 |
| 2019/0177125 | A1* | 6/2019 | Gainche | B66B 7/026 |

FOREIGN PATENT DOCUMENTS

| | | | |
|---|---|---|---|
| JP | 7-81863 | A | 3/1995 |
| JP | 2007-131402 | A | 5/2007 |
| WO | WO 2012/038760 | A2 | 3/2012 |
| WO | WO 2015/084364 | A1 | 6/2015 |

OTHER PUBLICATIONS

Search Report issued in European priority application 15172524, dated Oct. 14, 2015.
Written Opinion of the International Searching Authority, issued in PCT/FI2016/050415, PCT/ISA/237, dated Sep. 12, 2016.

* cited by examiner

SOLUTION FOR DISPLACING AN ELEVATOR CAR

CROSS REFERENCE TO RELATED APPLICATIONS

This application is a Continuation of PCT International Application No. PCT/FI2016/050415 filed on Jun. 10, 2016, which claims priority under 35 U.S.C. § 119(a) to Patent Application No. 15172524.9 filed in Europe on Jun. 17, 2015, all of which are hereby expressly incorporated by reference into the present application.

TECHNICAL FIELD

The invention concerns in general the technical field of elevator technology. Especially the invention concerns a solution for displacing an elevator car from its pathway.

BACKGROUND

So called multicar solutions have been under interest in elevator solutions for a long time. The multicar solution refers to an implementation wherein multiple elevator cars are arranged to travel, at least temporarily, in the same pathway, such as in the same shaft. It is clear that a challenge in such an environment is that one elevator car may block a travel of another elevator car in the shaft causing delays in the service of passengers.

Some solutions are introduced to mitigate the mentioned challenge. First field of solutions is based on an idea to shape the shaft in such a manner that elevator cars may by-pass each other in at least some section of the shaft. For example, a specific by-passing area may be optimally arranged in the shaft.

Another field of solutions is based on an arrangement in which an elevator car may be horizontally displaced from the shaft. The horizontal displacement may e.g. happen between two shafts, i.e. one elevator car may be displaced from one shaft to another, or so that an elevator car is horizontally displaced from the shaft to a by-pass location in order to enable other cars to by-pass the displaced car. This kind of solution is typically based on an arrangement in which a horizontal guide rail is used for displacing the elevator car horizontally. The elevator car is brought in one way or another so that it is fastened to the horizontal guide rail and the elevator car is displaced away from the shaft along the horizontal shaft. In some recent implementation the horizontal movement of the elevator car is enabled so that a section of a vertical guide rail is arranged to rotate 90 degrees, as well as a linear motor of the elevator car providing the power for moving the car along the guide rail, in order to arrange a horizontal path for the displacement.

Even though the known solutions as described are operational as such the problem is still an efficiency of the described solutions. Especially, the solutions utilizing the horizontal guide rails has a drawback that arranging the elevator car to the horizontal path requires that the elevator car stands still and waits until the guide rail is rotated in a horizontal position and/or until the elevator car is fastened to the horizontal guide rail if the arrangement e.g. comprises fixed horizontal rails. All in all, the mentioned drawbacks degrade the efficiency of the multicar solutions. Hence, there is need to mitigate the drawbacks.

SUMMARY

An objective of the invention is to present an apparatus and an elevator system for displacing an elevator car from its pathway. Another objective of the invention is that the apparatus and the elevator system for displacing the elevator car from its pathway improve an efficiency of an elevator solution.

The objectives of the invention are reached by an apparatus and an elevator system as defined by the respective independent claims.

According to a first aspect, an apparatus for displacing an elevator car from its pathway is provided wherein the apparatus comprising: a rotational vehicle configured to rotate around an axis of rotation; and at least one guide rail section mounted with the rotational vehicle along which at least one guide rail section the at least one elevator car is arranged to travel, wherein the at least one guide rail section is mounted substantially parallel to the axis of rotation of the rotational vehicle, and wherein the rotational vehicle is configured to rotate 90 degrees.

The apparatus may comprise at least two guide rail sections, wherein each two guide rail sections are configured to be mounted substantially parallel to each other and in 90 degrees with respect to each other from the axis of rotation point of view.

The rotational vehicle may comprise two ring-type elements arranged to rotate with respect to each other. An inner ring-type element may be fixedly mounted and the interface between the ring-type elements is a bearing solution.

According to a second aspect, an elevator system is provided wherein the elevator system comprising: at least one elevator car; and at least one apparatus which comprises a rotational vehicle configured to rotate around an axis of rotation and at least one guide rail section mounted with the rotational vehicle along which at least one guide rail section the at least one elevator car is arranged to travel, wherein the at least one guide rail section is mounted substantially parallel to the axis of rotation of the rotational vehicle, and wherein the rotational vehicle is configured to rotate 90 degrees.

The at least one apparatus in the system may comprise at least two guide rail sections, wherein each two guide rail sections are configured to be mounted substantially parallel to each other and in 90 degrees with respect to each other from the axis of rotation point of view.

The at least one elevator car may be arranged to be movably mounted to the guide rail section from an edge of the elevator car being parallel to the guide rail section in order to enable the travel of the at least one elevator car along the guide rail section in question.

The elevator car may be mounted to the guide rail section by means of at least one roller guide.

The at least one elevator car may also comprise door openings on the sides connected by the edge from which the elevator car is arranged to be movably mounted to the guide rail section.

The elevator system may comprise at least two apparatuses being coupled to each other. The coupling of the at least two apparatuses may be arranged with one of the following: magnetic locking, mechanical locking. The apparatuses may be configured to rotate synchronously.

The exemplary embodiments of the invention presented in this patent application are not to be interpreted to pose limitations to the applicability of the appended claims. The verb "to comprise" is used in this patent application as an open limitation that does not exclude the existence of also un-recited features. The features recited in depending claims are mutually freely combinable unless otherwise explicitly stated.

The novel features which are considered as characteristic of the invention are set forth in particular in the appended claims. The invention itself, however, both as to its construction and its method of operation, together with additional objectives and advantages thereof, will be best understood from the following description of specific embodiments when read in connection with the accompanying drawings.

BRIEF DESCRIPTION OF FIGURES

The embodiments of the invention are illustrated by way of example, and not by way of limitation, in the figures of the accompanying drawings.

FIG. 5 illustrates an arrangement in which multiple apparatuses according to an example of the invention are applied to.

DESCRIPTION OF SOME EMBODIMENTS

The present invention is at least partially based on an idea that an elevator car may be displaced from its travel path, such as from a shaft, at least by means of a rotational movement. More specifically, the idea is that the elevator car is arranged to travel along at least one guide rail, which comprises at least one guide rail section which is rotatable around an axis of rotation parallel to the guide rail section.

Figure 1:
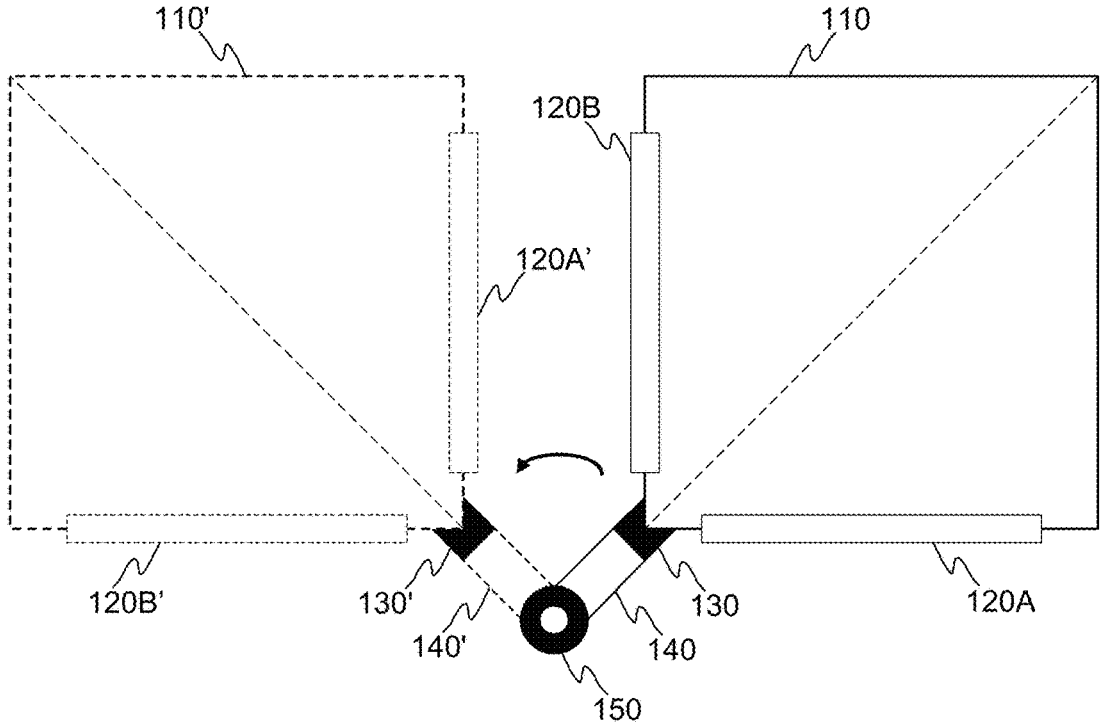
FIG. 1 illustrates schematically an example of the present invention from one perspective.

FIG. 1 illustrates schematically the principle of the invention from a travel path perspective. The FIG. 1 depicts an elevator system in two positions wherein the first position is depicted with solid line and the second position is depicted with dashed line. In the first position at least one elevator car 110 is arranged to travel along a first travel path. The elevator car 110 is movably mounted to a guide rail 140 which is fixed to a structure, such as to a wall of a shaft. The mounting of the elevator car 110 to the guide rail 140 may be implemented with one or more applicable roller guide 130 fixed to the elevator car 110, which roller guide(s) 130 are adjusted to travel along at least one guide rail 140 in order to keep the elevator car 110 properly aligned in its pathway. The guide rail 140 is, according to an example of the invention, mounted to a rotational vehicle 150 by means of which it is possible to provide rotational force through the guide rail 140 and one or more roller guide(s) to the elevator car 110 for displacing the elevator car 110 from its original pathway. The interface between the guide rail(s) 140 and the roller guide(s) is not in the focus of the present invention as such and any commonly known solution may be used. The elevator car 110 as depicted in the FIG. 1 may comprise one or more elevator doors, or openings, 120A, 120B. The locations of the doors, or openings, 120A, 120B may be chosen so that passengers may enter and exit from the elevator car appropriately. In the example of FIG. 1 the passengers enter and exit from the elevator on the same side, i.e. through a door, or opening, 120A in the first position and through a door, or opening, 120B' in the second position. The elements belonging to the solution according to an example of the present invention are provided with an apostrophe for improving the clarity in the FIG. 1.

As may be concluded from the FIG. 1 an angle of rotation of the rotational vehicle is advantageously 90 degrees. This is especially true in a situation where the passengers enter to and exit to from the elevator on the same side and wherein the elevator car may travel in two parallel pathways, such as shafts. With the 90 degree rotation the elevator car 110 may be displaced between the pathways with a minimum effort and efficiently. Additionally, the 90 degree rotation angle enables a use of existing traditional shafts in buildings, as there is no need to modify the shafts at all. It is also important to understand that the safety aspects may also be taken into account in a better way with 90 degree rotation angle solutions, because if one elevator car 110 misoperates, it is possible to drive another elevator car 110 beside the misoperating one and shift passengers from one car to another by opening the doors of the cars being opposite each other. Naturally this requires that elevator cars are equipped with such doors.

Figure 2:
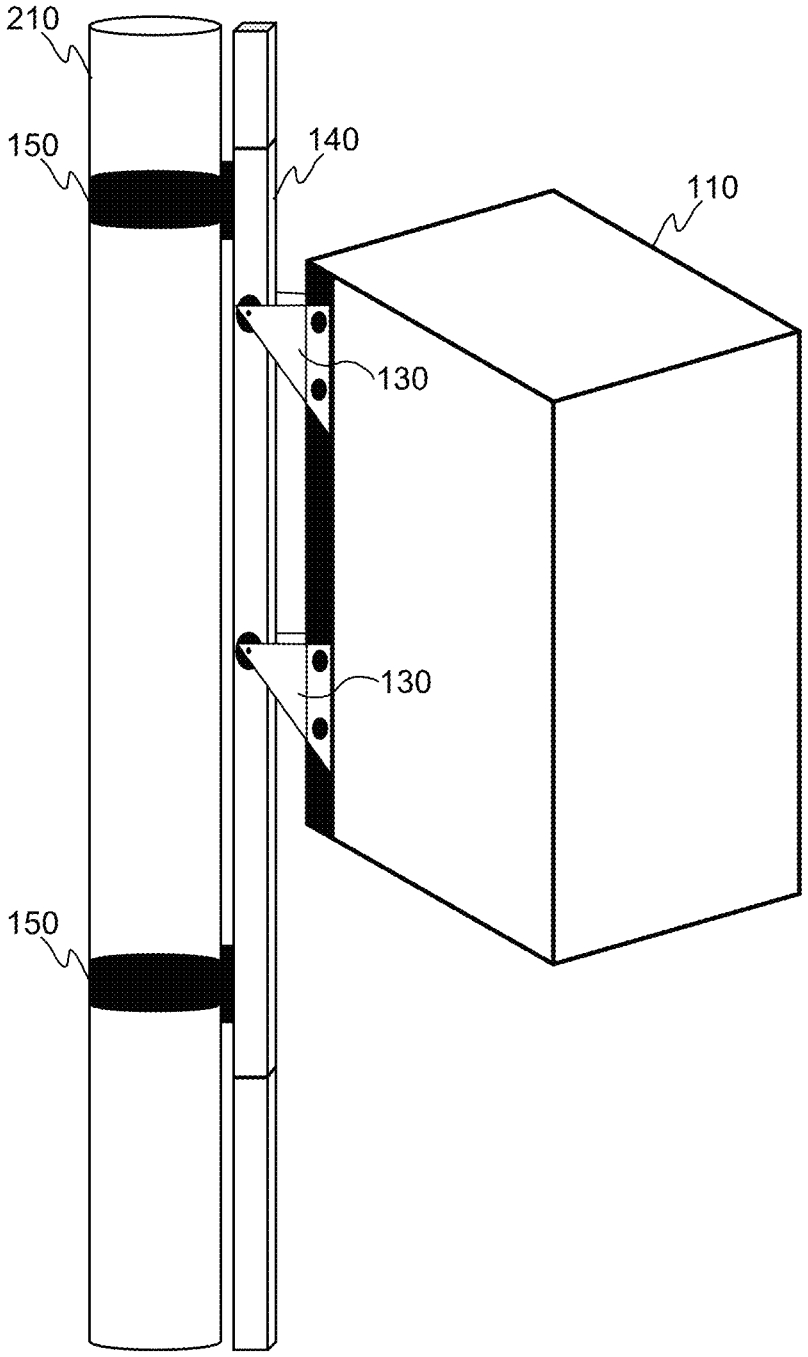
FIG. 2 illustrates schematically an example of the present invention from another perspective.

FIG. 2 illustrates schematically an example of the present invention from another perspective i.e. essentially sideways. As said, the elevator car 110 is arranged to travel along a guide rail wherein at least one guide rail section 140 is arranged rotatable by means of a rotational vehicle 150. The elevator car 110 is movably mounted to the guide rail with one or more roller guides 130. The rotatable guide rail section 140 is arranged to be mounted with the rotational vehicle 150 thus being part of the rotational vehicle. The mounting method may be any such, which provides hard enough mounting strength in the application area. For example, the mounting may be implemented with, but is not limited to, welding or bolted joint as well as a combination of these. The rotational vehicle 150, and thus the guide rail section 140 and the elevator car 110, is arranged rotatable around an axis of rotation parallel to the guide rail section 140, wherein the angle of rotation is preferably 90 degrees.

The operation of the rotational vehicle 150 may be implemented in multiple ways so that the rotational vehicle 150 and finally the elevator car 110 may be displaced from the pathway in the manner as described. As said the elevator car 110 is brought to rotate around a rotational axis, which is substantially parallel to the guide rail section 140. In the example as depicted in FIG. 2 the rotational vehicle is arranged around a central pillar 210. The power forcing the rotational movement of the elevator car 110 may be brought to the elevator system in multiple ways. According to an example of the invention the power may be brought to the system so that the central pillar 210 comprises one or more sections which are arranged to be rotatable. Advantageously, the rotational vehicle 150 is mounted to the mentioned one or more sections of the central pillar 210 so that when the one or more sections of the central pillar 210 is rotated the rotational vehicle also rotates.

As discussed, the present invention may be utilized and implemented in an elevator system where there are multiple elevator cars traveling in the same pathways, e.g. in two shafts, and wherein there is need to displace the elevator cars, or at least one of them, from one shaft to another. Since there is a plurality of elevator cars 110 traveling in the pathways, such as in the shafts, it is necessary to guarantee that the guide rails exist always in full length in all the pathways where the elevator cars travel. In other words, if a guide rail section 140 is rotated according to the example of the present invention from one position to another, it is advantageously arranged so that the rotated guide rail section 140 is replaced with another guide rail section. Preferably this is implemented so that the replacing guide rail section is brought in the position of the rotated guide rail section concurrently when the guide rail section in question is rotated.

Figure 3A:
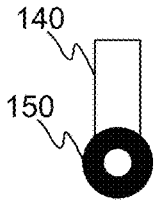
FIGS. 3A-3D illustrate schematically examples of an apparatus according to the present invention.
Figure 3B:
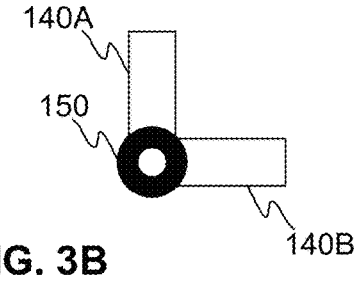
Figure 3C:
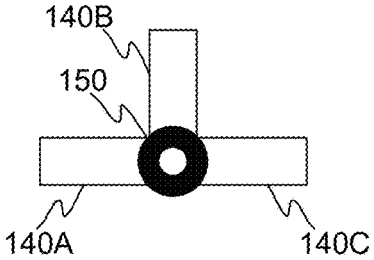
Figure 3D:
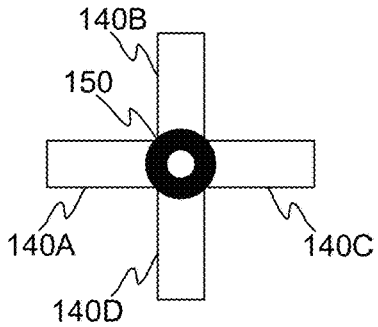

FIGS. 3A-3D illustrate schematically examples of an apparatus according to the present invention by means of which the displacement of an elevator car may be at least partly implemented. The apparatus comprises a rotational vehicle 150 and at least one guide rail section 140. In the simplest implementation, as depicted in FIG. 3A, the apparatus comprises only one guide rail section mounted with the rotational vehicle 150. This kind of implementation enables displacement of the elevator car 110 from one pathway to another, but has a limitation that the guide rail becomes broken in the pathway from which the guide rail section 140 is rotated. FIG. 3B depicts an apparatus according to an example of the invention by means of which the rotated guide rail section, e.g. 140A, may be replaced with another guide rail section, e.g. 140B in FIG. 3B. The guide rail sections 140A, 140B are advantageously mounted in positions being 90 degrees with respect to each other. However, as one may conclude the implementation according to FIG. 3B has a limitation in a case where there are two separate pathways, such as two shafts, for two or more elevator cars 110. Namely, even if in a starting position both guide rail sections 140A, 140B are positional along guide rails in the two pathways, the situation changes when one elevator car 110 is displaced from one pathway to another. Then, both guide rail sections 140A, 140B rotate simultaneously leaving a broken guide rail to the other pathway, which is not desirable. In order to solve the problem the apparatus preferably comprise three, as in FIG. 3C, or four, as in FIG. 3C, guide rail sections 140A, 140B, 140C, 140D mounted with the rotational vehicle 150. The implementation of the apparatus as illustrated in FIG. 3D is especially advantageous since it enables displacement of the elevator car 110 from its pathway to any direction of 90 degrees, because a replacing guide rail section is always brought to replace the rotated one from the pathway. In such a manner the safety requirements may be met in the elevator system environment and as a result the efficiency of the elevator system may be optimized.

Figure 4:
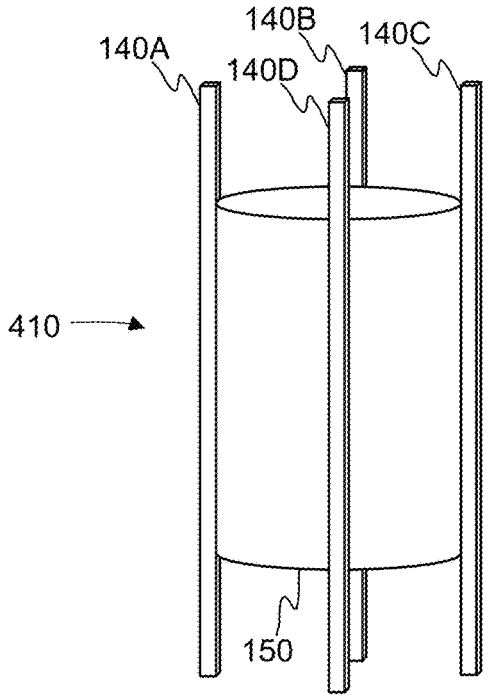
FIG. 4 illustrates an example of an apparatus according to the present invention.

FIG. 4 illustrates an apparatus 410 corresponding to FIG. 3D from another perspective. The apparatus 410 comprises four guide rail sections 140A, 140B, 140C, 140D mounted with the rotational vehicle 150. The mounting of the guide rail sections 140A, 140B, 140C, 140D is advantageously arranged so that the mounting positions are symmetrically around the rotational vehicle 150 in 90 degrees with respect to each other. Even if the rotational vehicle 150 is illustrated in a drum-like solution in the figures the shape of it may be any other than the illustrated one.

Figure 5:
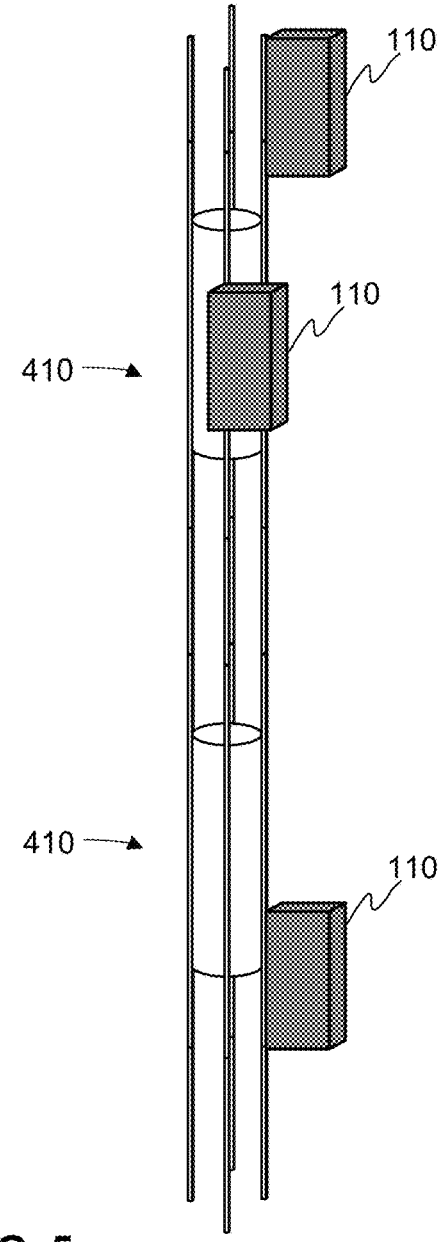

FIG. 5 illustrates an arrangement in which multiple described apparatuses 410 are arranged to elevator car pathways, such as shafts. In the illustrated example three elevator cars 110 are arranged to travel in the same pathways. Any of the elevator cars 110 may be displaced from one pathway to another by means of the apparatus 410 according to the invention. This may happen when an elevator car 110 arrives in an operational area of an apparatus 410 i.e. the elevator car 110 in question travels along one of the guide rail sections 140A, 140B, 140C, 140D belonging to the apparatus 410. In case the elevator car 410, e.g. due to a destination address or for any other reason, shall be displaced to another pathway a rotation of the apparatus is initiated. This covers both that the elevator car 410 in question is stopped, i.e. there is no vertical motion, in the operational area of the apparatus 410, and that the elevator 410 continues the travel at least partly concurrently with the rotational operation of the apparatus 410. By combining the rotation movement with the vertical movement the efficiency of an elevator system may be improved which is a clear advantage compared to known solutions. Additionally, as the elevator car is always fastened to a guide rail section though applicable means the safety requirements may be fulfilled better than in at least some prior art solutions. Naturally, the lengths of guide rail sections 140A, 140B, 140C, 140D shall be optimally selected in an implementation in which both the rotational movement and the vertical movement happens at least partly concurrently. Moreover, the travel speed of the elevator car 110 may be adjusted accordingly. The positions of the apparatuses may also be selected optimally within the pathways so that the service speed of the elevators is optimal to the need. As said, the implementation illustrated in FIG. 5 is only an example and the inventive idea of the present invention is not limited only to that. For example, the number of apparatuses within the pathways may vary according to the need. Moreover, the implementation utilizing the apparatuses according to the present invention may be arranged so that the apparatuses are different or the same within the limits of the present invention. In other words, it may e.g. be arranged so that one apparatus may be configured to displace only one elevator car 110 at a time, i.e. comprising only one guide rail section, whereas another apparatus may be configured to displace multiple elevator cars 110 at the time i.e. comprising a plurality of guide rail sections.

According to one implementation of the present invention the apparatuses may be arranged successively in the pathway. This means at least that that the successive rail sections 140A, 140B, 140C, 140D in vertical direction, or in the pathway direction, are from different apparatuses. This extends the rotational section within the elevator implementation so that it improves the efficiency of the elevator system as there is possibility to displace the elevator cars in a longer pathway. Such an implementation may require that different apparatus are configured to operate synchronously with respect to each other. In order to maintain the synchronized rotation of the different apparatuses the apparatuses may be configured to couple the apparatuses together e.g. with magnetic and/or mechanical locking. The locking may be arranged between the successive rail sections, but also in such a manner that the rotational vehicles are arranged to be coupled together with locking mechanisms arranged in the rotational vehicles, which may be coupled e.g. with magnetic and/or mechanical way.

Further, in some implementation multiple apparatuses according to the examples of the invention may be arranged in the same pathway section in an overlapping manner. This means that two or more individual apparatuses may displace elevator cars from one pathway to another in the same section. Such an implementation may be preferred especially if there are arranged more than two pathways, e.g. three, around a rotational axis.

Typically buildings are designed so that elevator shafts are arranged beside each other so that the entrances of the adjacent elevators are arranged on the same side. It is also usually so that the elevator cars are cuboid in shape, or specifically a rectangular cuboid, in order to optimize an area and volume utilization factor in buildings. Also elevator cars having a bottom area quadrant in shape may be advantageous because the space needed for the rotation is optimized.

Taken these limits as granted the present invention is optimally configured so that the elevator cars 110 are mounted with the guide rails through any mounting means, such as roller guides, along an edge of the elevator car 110 being parallel to the guide rail. Advantageously the mounting angle is adjusted so that a diagonal of the bottom or roof rectangular continues along the mounting means towards the guide rail through the axis of rotation (the diagonals are illustrated in FIG. 1 with dashed line in the elevator cars). Such an implementation enables choosing the rotational angle of 90 degrees in the described setup of buildings. However, the invention is not limited to 90 degree rotational angle only since the shape of the elevator car may have impact to the required rotational angle.

Figure 6:
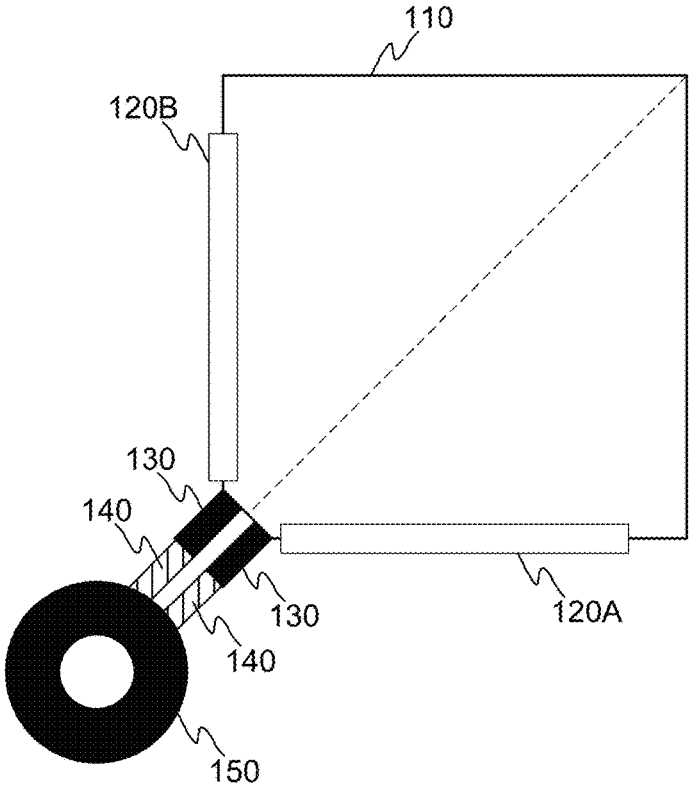
FIG. 6 illustrates an example of a further implementation of the present invention.

In the description above the inventive idea is described so that the apparatus according to the invention comprises only one guide rail section for mounting, or attaching, the elevator car 110 movably in the elevator system. The inventive idea covers also any such solution wherein there is a plurality of guide rail sections in the apparatus for mounting the elevator car in one pathway. Such an implementation is illustrated in FIG. 6 wherein the two guide rail sections 140 are mounted with the rotational vehicle 150. The counterpart or counter-parts to the guide rails in the elevator car are to be chosen accordingly. It is clear the number of guide rails is an implementation based selection and advantageously, but not necessarily, all sets of guide rails and guide rail sections are similar in the apparatus and the elevator system according to the invention. As disclosed one set of guide rail sections in the apparatus may comprise one or more individual guide rail sections 140.

Figure 7A:
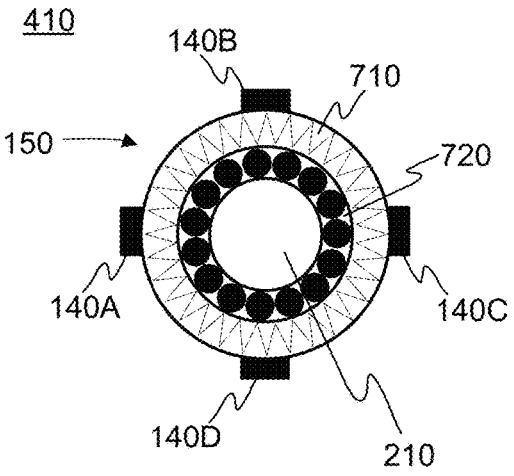
FIGS. 7A and 7B illustrate schematically an example of a rotational vehicle according to the present invention.
Figure 7B:
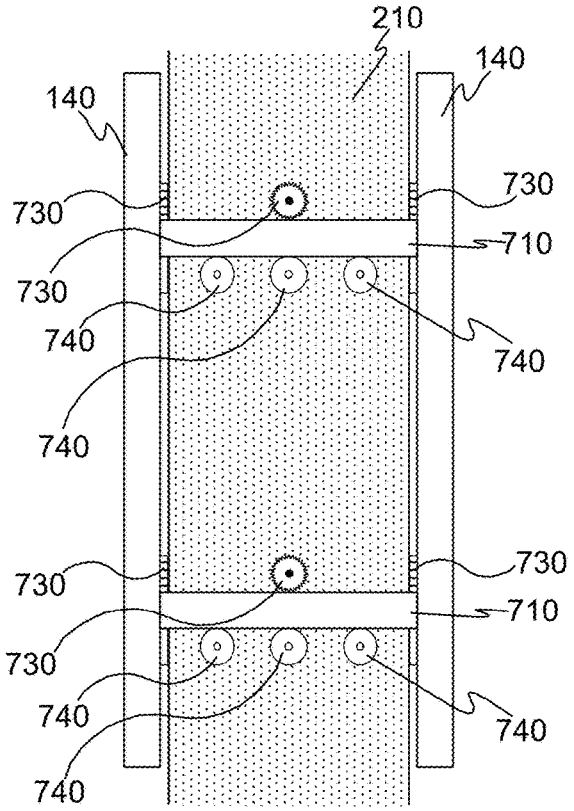

FIGS. 7A and 7B illustrate an example of an apparatus according to the invention. The apparatus 410 may comprise a rotational vehicle 150 having at least two concentric ring-type elements 710, 720. The ring-type elements 710, 720 are configured to rotate with respect to each other. The interface between the elements 710, 720 may e.g. be implemented with bearing arrangement, which is to be implemented in at least one of the elements 710, 720. The bearing, such as ball bearing, is advantageously selected so that the friction between the elements is minimized during the rotation. The inner ring-type element 720 is to be mounted to the central element forming the entity around which the rotational motion happens. The central element may e.g. be a central pillar 210, as depicted in the FIG. 2. The outer ring-type element 710 is arranged to rotate around the element 720 causing the guide rail section(s) to rotate.

The rotational force may e.g. be brought to the apparatus 410 by means of one or more cogwheels 730 mounted in an appropriate way e.g. to the central element 210 and which may be arranged to interact with the rotating element 710 of the rotational vehicle 150. An example of such a solution is disclosed in FIG. 7B. The element 710 comprises advantageously such a surface that the cogwheel 730 may interact with it in an efficient way. For example, the element 710 may be provided with such a surface which is adjusted with the teeth number of the cogwheel(s) 730. The rotational vehicle may e.g. be arranged to rest on a plurality of stabilizing rollers 740. The rollers may be configured to follow the rotational motion of the rotational vehicle 150. The force to the cogwheel(s) may be brought from an electrical motor, which may be controlled by a system managing an operation of the whole elevator system, for example. Additionally, any sensors may be arranged in the solution in order to monitor the operation of the rotational vehicle. For example, advantageously such sensors are arranged in the pathway by means of which it is possible to detect that an elevator car to be displaced from the pathway arrives in a section, which is rotatable.

In the description of the present inventive idea there is not taken any standpoint to the type or shape of guide rails or guide rail sections as such. This is because the present inventive idea is applicable as such with any guide rail type or shape as long as it may be mounted with the rotational vehicle 150 causing the effect as described and as long as the elevator car 110 may be guided along the guide rail type or shape in question together with any necessary counter-element mounted in the elevator car 110, such as applicable roller guide(s) 130.

The dimensions in the implementation of the present invention may vary from those shown in the Figures. The Figures are drawn schematically for disclosing the inventive idea of the present invention in an appropriate way.

Features described in the preceding description may be used in combinations other than the combinations explicitly described. Although functions have been described with reference to certain features, those functions may be performable by other features whether described or not. Although features have been described with reference to certain embodiments, those features may also be present in other embodiments whether described or not.

The invention claimed is:

1. An apparatus for displacing an elevator car from its pathway, the apparatus comprising:

a rotational vehicle configured to rotate around an axis of rotation; and at least one guide rail section mounted with the rotational vehicle along which at least one guide rail section the at least one elevator car is arranged to travel, wherein the at least one guide rail section is mounted substantially parallel to the axis of rotation of the rotational vehicle, wherein the rotational vehicle is configured to rotate 90 degrees, and wherein the rotational vehicle comprises:

a central pillar;

one or more cogwheels mounted to the central pillar, an inner ring-type element fixedly mounted to the central pillar; and an outer ring-type element arranged radially outward of the inner ring-type element, the at least one guide rail section being mounted to the outer ring-type element, the inner and outer ring-type elements forming a bearing so that the outer ring-type element along with the at least one guide rail section is rotatable with respect to the inner ring-type element by a rotation force, wherein the one or more cogwheels are configured to interact with the outer ring-type element to provide said rotation force.

2. The apparatus of claim 1, wherein the apparatus comprises at least two guide rail sections, wherein each two guide rail sections are configured to be mounted substantially parallel to each other and in 90 degrees with respect to each other from the axis of rotation point of view.

3. An elevator system comprising:

at least one elevator car; and at least one apparatus comprising:

a rotational vehicle configured to rotate around an axis of rotation; and at least one guide rail section mounted with the rotational vehicle along which at least one guide rail section the at least one elevator car is arranged to travel, wherein the at least one guide rail section is mounted substantially parallel to the axis of rotation of the rotational vehicle, wherein the rotational vehicle is configured to rotate 90 degrees, and wherein the rotational vehicle comprises:

a central pillar;

one or more cogwheels mounted to the central pillar, an inner ring-type element fixedly mounted to the central pillar; and an outer ring-type element arranged radially outward of the inner ring-type element, the at least one guide rail section being mounted to the outer ring-type element, the inner and outer ring-type elements forming a bearing so that the outer ring-type element along with the at least one guide rail section is rotatable with respect to the inner ring-type element by a rotation force, wherein the one or more cogwheels are configured to interact with the outer ring-type element to provide said rotation force.

4. The elevator system of claim 3, wherein the at least one apparatus comprises at least two guide rail sections, wherein each two guide rail sections are configured to be mounted substantially parallel to each other and in 90 degrees with respect to each other from the axis of rotation point of view.

5. The elevator system of claim 4, wherein the at least one elevator car is arranged to be movably mounted to the guide rail section from an edge of the elevator car being parallel to the guide rail section in order to enable the travel of the at least one elevator car along the guide rail section.

6. The elevator system of claim 4, wherein the elevator car is mounted to the guide rail section by means of at least one roller guide.

7. The elevator system of claim 4, wherein the at least one elevator car comprises door openings on sides connected by an edge from which the elevator car is arranged to be movably mounted to the guide rail section.

8. The elevator system of claim 4, wherein the elevator system comprises at least two apparatuses being coupled to each other, and each of the at least two apparatuses comprises at least one guide rail section.

9. The elevator system of claim 3, wherein the at least one elevator car is arranged to be movably mounted to the guide rail section from an edge of the elevator car being parallel to the guide rail section in order to enable the travel of the at least one elevator car along the guide rail section in question.

10. The elevator system of claim 9, wherein the elevator car is mounted to the guide rail section by means of at least one roller guide.

11. The elevator system of claim 9, wherein the at least one elevator car comprises door openings on sides connected by an edge from which the elevator car is arranged to be movably mounted to the guide rail section.

12. The elevator system of claim 3, wherein the elevator car is mounted to the guide rail section by means of at least one roller guide.

13. The elevator system of claim 12, wherein the at least one elevator car comprises door openings on sides connected by an edge from which the elevator car is arranged to be movably mounted to the guide rail section.

14. The elevator system of claim 3, wherein the at least one elevator car comprises door openings on sides connected by an edge from which the elevator car is arranged to be movably mounted to the guide rail section.

15. The elevator system of claim 3, wherein the elevator system comprises at least two apparatuses being coupled to each other, and each of the at least two apparatuses comprises at least one guide rail section.

16. The elevator system of claim 15, wherein the coupling of the at least two apparatuses is arranged with one of the following: magnetic locking, mechanical locking.

17. The elevator system of claim 15, wherein the apparatuses are configured to rotate synchronously.

* * * * *